US006212790B1

(12) United States Patent
Stetson

(10) Patent No.: US 6,212,790 B1
(45) Date of Patent: Apr. 10, 2001

(54) PROTECTIVE COVER FOR HAIRDRYER

(76) Inventor: Delia Stetson, 3221 Overland Ave. #6214, Los Angeles, CA (US) 90034

( * ) Notice: Subject to any disclaimer, the term of this patent is extended or adjusted under 35 U.S.C. 154(b) by 0 days.

(21) Appl. No.: 09/523,197

(22) Filed: Mar. 10, 2000

Related U.S. Application Data

(60) Provisional application No. 60/129,376, filed on Apr. 15, 1999.

(51) Int. Cl.[7] ..... A45D 24/10

(52) U.S. Cl. ..... 34/97; 34/103

(58) Field of Search ..... 34/96, 97, 98, 34/99, 100, 101; 132/112, 212; 2/174, 204; 392/380, 384, 385

(56) References Cited

U.S. PATENT DOCUMENTS

| | | | | |
|---|---|---|---|---|
| 2,597,552 | | 5/1952 | Wagner . | |
| 4,230,279 | * | 10/1980 | Forsberg | 34/97 X |
| 4,361,966 | * | 12/1982 | Downey | 34/99 |
| 4,925,149 | | 5/1990 | DiFrancesca et al. . | |
| 4,934,068 | * | 6/1990 | Curlee | 34/99 |
| 5,265,720 | | 11/1993 | Meliconi . | |
| 5,392,920 | | 2/1995 | Prete . | |
| 5,562,209 | | 10/1996 | Jackson et al. . | |
| 5,648,757 | | 7/1997 | Vernace et al. . | |
| 5,649,370 | * | 7/1997 | Russo | 34/97 |
| 6,011,903 | * | 1/2000 | Nosenchuck | 34/97 X |

FOREIGN PATENT DOCUMENTS 2064319 6/1981 (GB) .

* cited by examiner

*Primary Examiner*—Stephen Gravini
(74) *Attorney, Agent, or Firm*—Richard C. Litman

(57) ABSTRACT

Various embodiments of a protective resilient cover for hand held hairdryers serve to protect the shell or housing and motor and other components therein from damage in the event the hairdryer is dropped or otherwise suffers an impact. One embodiment of the present invention comprises a pair of resilient bands which are joined at their ends and which extend about the surface of the body of the hairdryer generally opposite the hand grip. The joined ends of the bands include elastic straps connecting them together, for securing the cover about the hairdryer. In another embodiment, the bands are formed integrally of a single piece of material, rather than being sewn or otherwise secured together from two separate pieces. Yet another embodiment utilizes separably fastenable connecting material (e.g., Velcro™, snap fasteners, etc.) for securing the protective device about the body of the hairdryer. Still another embodiment is configured for protecting a side vent or inlet type hairdryer, and comprises a generally circumferential band which wraps about the majority of the arcuate outer surface of the appliance with removable attachment being provided by separable mating fastener straps which wrap about the opposite portion of the hairdryer. At least one side of this embodiment is open for airflow through the side inlet. Each of the embodiments may comprise a resilient foam material having a water resistant or waterproof cover, or the cover may comprise an impervious resilient shell which is liquid or pneumatically filled.

18 Claims, 6 Drawing Sheets

PROTECTIVE COVER FOR HAIRDRYER

REFERENCE TO RELATED PATENT APPLICATION

This application claims the benefit of U.S. Provisional Patent Application Serial No. 60/129,376 filed on Apr. 15, 1999.

BACKGROUND OF THE INVENTION

1. Field of the Invention

The present invention relates generally to pads, covers, and the like for protecting various devices from damage due to impact, and more specifically to a protective cover for a hand held electric hairdryer to preclude damage thereto if the device is dropped or otherwise receives a sharp impact.

2. Description of the Related Art

Electromechanical devices are generally relatively fragile, and are subject to damage if dropped or otherwise suffer from an impact. While solid state devices are also subject to such impact damage, devices having electrically resistive heating elements, electric motors, switches, etc., are particularly prone to impact damage in the event of a sudden physical shock, as by dropping the device on a hard floor or similar impact.

The above statement applies particularly to one specific type of electrical appliance, i.e., the portable, hand held electric hair dryer, and particularly when used in the hair-styling or beauty salon environment. Many, if not most, such appliances are configured for professional use and may have greater durability for operating for a much higher percentage of the time than a household unit. However, this also means that they are handled a great deal more than a typical household unit of similar function, and are thus subject to accidental impact or dropping more frequently than a household unit as well. Add to this the fact that most salons where such devices are used have hard flooring for ease of cleanup, as opposed to the carpeting typically found throughout most rooms of a household, and it becomes apparent that the professionally used hand held hairdryer is subject to considerable wear and tear, particularly due to impact damage.

While manufacturers have done their best within the economic constraints imposed to produce devices which are resistant to such damage, the relatively heavy electric motors and the relatively fragile electrically resistive heating elements and plastic cases or housings result in such devices often being rendered inoperable if they are dropped onto a hard surface from just a few feet above the surface. Such devices are often damaged beyond economic repair when dropped, and the replacement of such devices is obviously quite costly.

Accordingly, a need will be seen for a padded protective cover for hand held hairdryers, which extends about the housing or case of the device to cushion the most massive portion of the hairdryer in the event of a fall. The present protective cover comprises one or more bands which extend about the upper or back surface of the motor housing, serving to cushion that area of the dryer particularly. The present protective cover is readily adaptable to various sizes and styles of hand held hairdryers by means of the adjustment provided, and includes clearances for the inlet area of various types and styles of hairdryers. The present cover is particularly well suited for protecting hand held hairdryers from damage, as the device will tend to orient itself with the relatively heavy motor housing positioned downwardly during a fall, due to the drag of the electrical cord and other lighter components. Thus, the present protective cover is particularly well suited for reducing or precluding damage to the hair dryer motor and its housing, which components are most likely to incur damage if not otherwise protected.

A discussion of the related art of which the present inventor is aware, and its differences and distinctions from the present invention, is provided below.

U.S. Pat. No. 2,597,552 issued on May 20, 1952 to Stanley T. Wagner, titled "Combined Cover And Silencer For Electric Shavers," describes a continuous wrapping of resilient strip material about the body of an electric razor, with the resilient material being covered by a continuous fabric sheet. The only openings provided in the Wagner cover are a relatively small access for the starting wheel for the particular make and model of electric razor for which the cover is constructed, and an openable cover for the shaver head itself. Wagner does not provide additional openings for air inlets and outlets, as provided by the present hairdryer protective cover. Moreover, Wagner covers the resilient material with a "textile material" (col. 2, lines 16, 17), but does not make any statement regarding water resistance for such material. In contrast, the present protective cover provides protection for the motor case or housing area without unnecessarily encompassing the remainder of the device, and provides a waterproof (or at least water resistant) covering for the protective padding.

U.S. Pat. No. 4,925,149 issued on May 15, 1990 to Peter DiFrancesca et al., titled "Shock Absorbing Unit," describes a unitary device formed of a molded resilient material for protecting a television remote control unit or the like. The DiFrancesca et al. device comprises opposed protective end components which slip over each end of the remote unit, with the two end components being connected by a single band of the same material as the end components. No outer cover of water resistant material is disclosed by DiFrancesca et al., as provided by the present protective cover. Moreover, DiFrancesca et al. teach away from the present invention, as the central portion of the remote unit is left exposed with the two ends being covered, essentially opposite the configuration of the present protective cover with its wraps about the central portion of the hairdryer.

U.S. Pat. No. 5,265,720 issued on Nov. 30, 1993 to Loris Meliconi, titled "Shock-Proof Protective Jacket For A Remote Control Unit," describes a device made of a resilient material which essentially encloses the entire remote unit, excepting the front face with its control panel. The sides, bottom, and both ends are completely enclosed by the Meliconi cover, unlike the present protective cover. Meliconi teaches away from the present cover, in that such remote control devices require only a single opening for signal transmission and do not require both inlet and outlet openings, as in the case of a hairdryer or similar device. In any event, the Meliconi device does not include a moisture-proof outer cover, as provided by the present invention, and the rectangular shape is not adaptable to the generally cylindrical body of a hairdryer, as provided by the present protective cover.

U.S. Pat. No. 5,392,920 issued on Feb. 28, 1995 to Richard Prete, titled "Impact Protector For Fragile Article," describes a device for protecting a small, hand held computer, calculator or the like. The Prete device comprises a peripheral frame formed of a relatively dense plastic, such as polyurethane or the like. The device has a pair of opposed flanges extending outwardly from the periphery for absorbing impact, while leaving the center of the device open and exposed. The Prete device is thus more closely related to the protective devices of the DiFrancesca et al. '149 and Meliconi '720 U.S. Patents discussed above, than to the present invention which leaves the ends of the hairdryer exposed while protecting the main body of the hairdryer.

U.S. Pat. No. 5,562,209 issued on Oct. 8, 1996 to Patricia N. Jackson et al., titled "Heat Resistant Curling Iron Cooler," describes a generally cylindrical curling iron holder with a conical mouth. The device has a foam rubber outer cover, with a heat resistant inner coating (Teflon™, etc.). The device completely encloses and covers the hot end of the iron when the iron is placed therein, whereas the present protective cover leaves both the inlet and outlet ends or vents open, in order to provide for operability of the hair dryer secured therein. Thus, the function of the Jackson et al. container is essentially opposite that of the present invention, as the Jackson et al. holder is intended for use only when the appliance is not being used, and is intended to preclude contact with the hot elements of the iron.

U.S. Pat. No. 5,648,757 issued on Jul. 15, 1997 to Salvatore J. Vernace et al., titled "Remote Control Protective Holder And Detection Device," describes a device for fitting about the periphery of a remote control device, while leaving the center open for access to the control keys. At least a portion of the device is formed of an elastomer material, but the device also includes electronic circuitry enabling it to be seen in the dark and providing a light source for the keypad portion of the controller. The peripheral padding, as opposed to the circumferential padding of the present protector, results in a device more closely related to the DiFrancesca et al. '149, Meliconi '720, and Prete '920 U.S. Patents discussed above, than to the present invention.

Finally, British Patent Publication No. 2,064,319 published on Jun. 17, 1981 to Handydryer Products Ltd., titled "Hair Drying Equipment," describes a rack or holder for holding a hand held hairdryer when the dryer is not in use. The device mounts semipermanently to the edge of a table, shelf, or the like, and does not secure to the hairdryer itself. The hairdryer only nests in the device when not in use, and is not positively secured to the Handydryer Products Ltd. holder in any way, as opposed to the present protective cover which is positively secured about the body of the hairdryer.

None of the above inventions and patents, taken either singly or in combination, is seen to describe the instant invention as claimed.

SUMMARY OF THE INVENTION

The present invention comprises a padded protective cover for a hand held hairdryer, essentially comprising plural bands of resilient material which extend about the generally ovoid body of the hairdryer. The resilient material is covered with a waterproof or at least water resistant protective covering. The bands are permanently joined at their ends with elastic straps or the like extending between the opposed joined ends to close the device and secure it about the body of the hairdryer. Other embodiments may utilize mating hook and loop fastener material (e.g., Velcro™) or other separably connectable fastening means to secure the protective device about the hairdryer.

Still other embodiments provide resilient pneumatically or liquid filled tubes for cushioning impact forces. Yet another embodiment provides protection for side vent type dryers, with vent openings provided to each side of the cover. These various embodiments may be combined as desired with one another to provide great versatility in the present hairdryer protective cover invention.

The present invention in its various embodiments thus provides a protective wrap about the main body of such a hand held hairdryer, serving to lessen impact forces to the body portion in the event the hairdryer is dropped or otherwise suffers an impact. The relatively heavy electric fan motor housed in the central body portion of such hairdryers, and the plastic case surrounding the motor, are particularly vulnerable to impact and are generally the first component of such hairdryers to contact the floor when the device is dropped. The present protective cover embodiments thus provide protection from damage in the vast majority of instances where such a hand held appliance may be dropped or otherwise suffer an impact.

Accordingly, it is a principal object of the invention to provide an improved protective cover for a hand held hairdryer, comprising a plurality of padded bands which wrap about the body of the hairdryer with ends secured to one another beneath the hairdryer body, to protect the body of the hairdryer with its motor and case.

It is another object of the invention to provide an improved protective cover for a hand held hairdryer, another embodiment of which comprises a wrap for removably securing about the majority of the outer circumference of a side inlet hairdryer and having open areas on at least one side thereof for clearance for the inlet opening of the hairdryer.

It is a further object of the invention to provide an improved hairdryer protective cover which may be formed of a resilient material covered with a waterproof or water resistant material, or which may be formed of hollow pneumatic or liquid filled tubular elements, as desired.

An additional object of the invention is to provide an improved hairdryer protective cover including means for removably securing the cover about the body of the hairdryer, as desired.

Still another object of the invention is to provide an improved hairdryer protective cover which removable attachment means may comprise permanently connected elastic bands or separably mating hook and loop or other fastener material as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
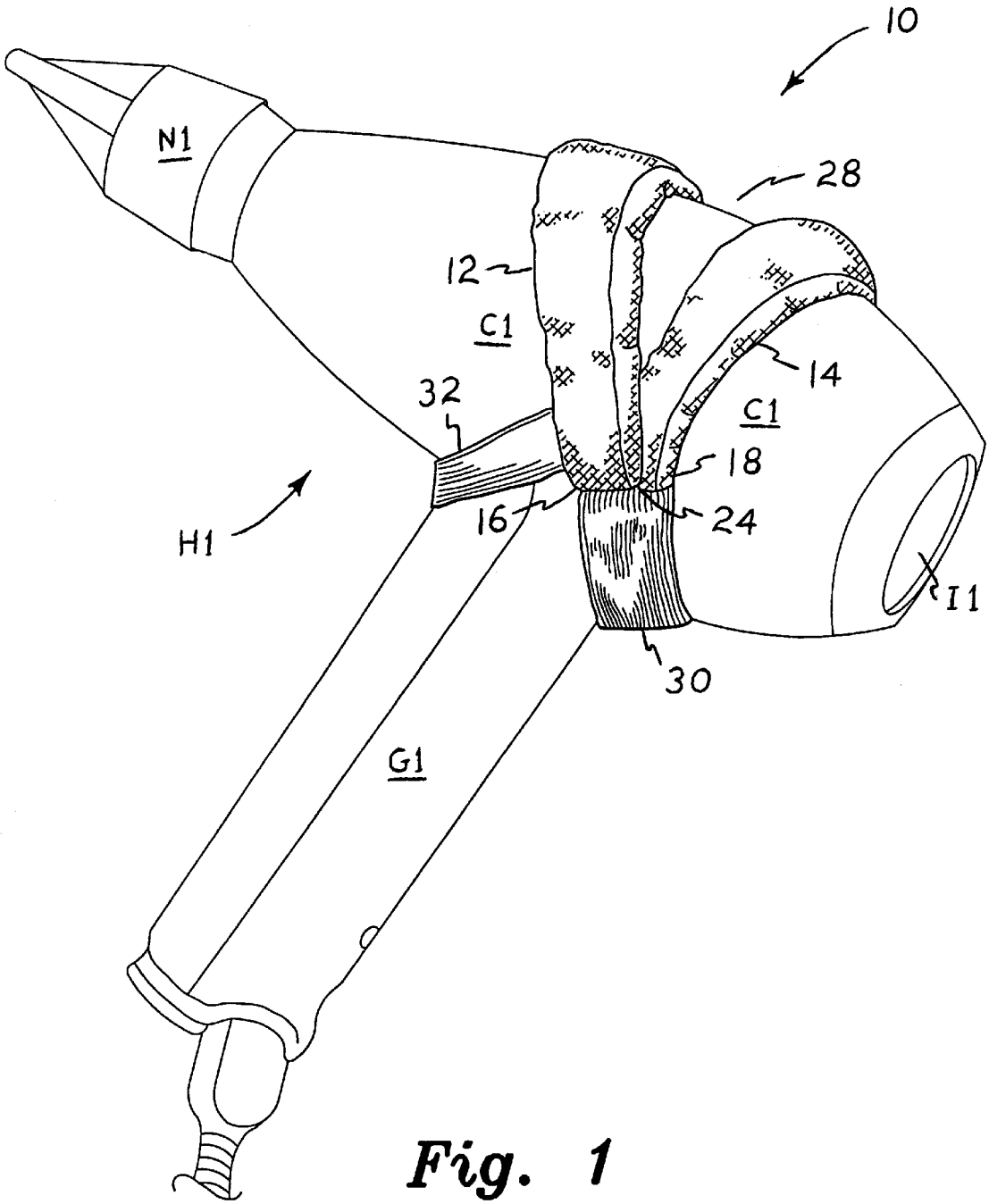
FIG. 1 is an environmental perspective view of a first embodiment of the present protective cover for hand held hairdryers, showing its installation upon such a hairdryer.
Figure 2:
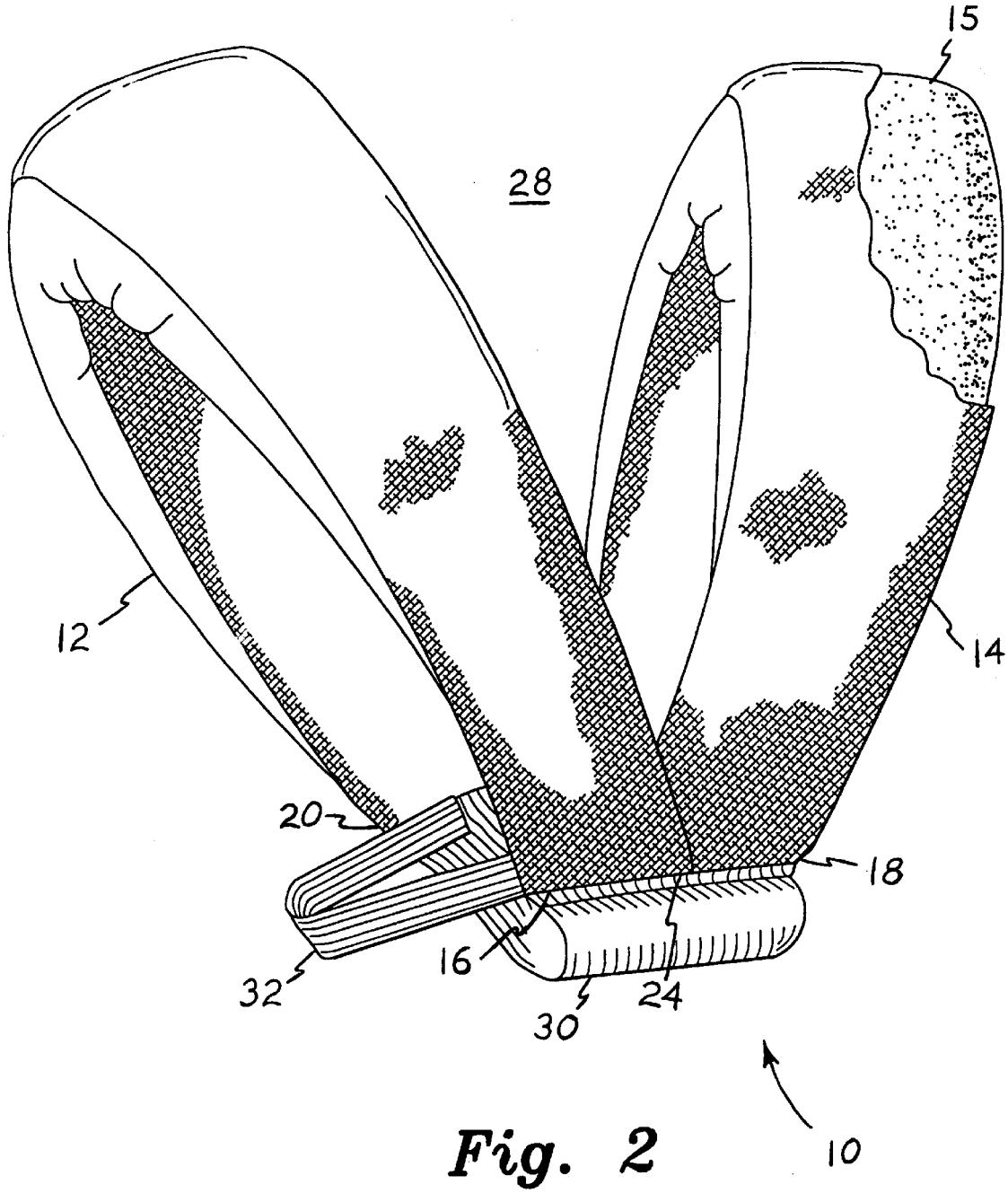
FIG. 2 is a side perspective view of the protective cover embodiment of FIG. 1, showing further details thereof.
Figure 3:
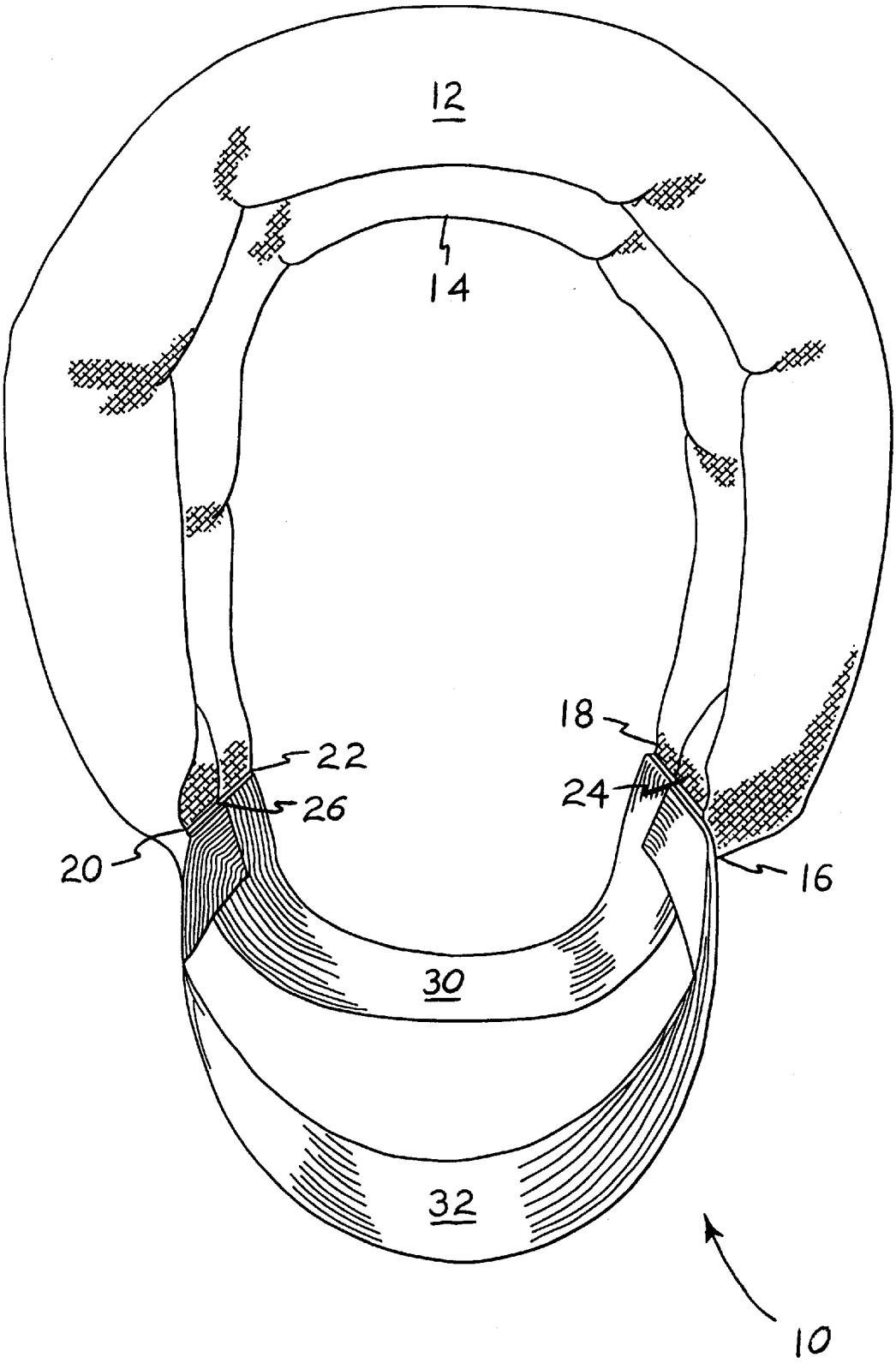
FIG. 3 is a front elevation view of the protective cover of FIGS. 1 and 2, illustrating further details.
Figure 6:
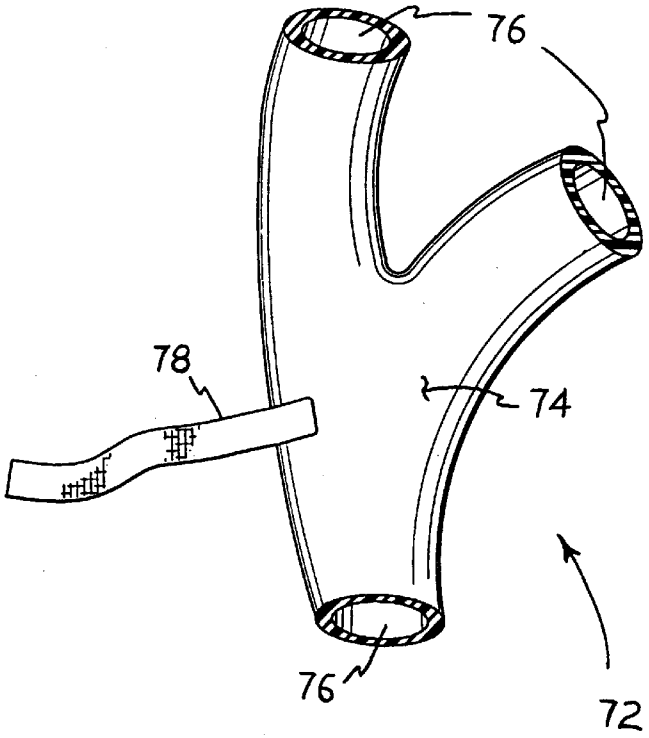
FIG. 6 is a broken away perspective view of yet another embodiment, illustrating a hollow core structure for pneumatic or liquid fill.
Figure 5:
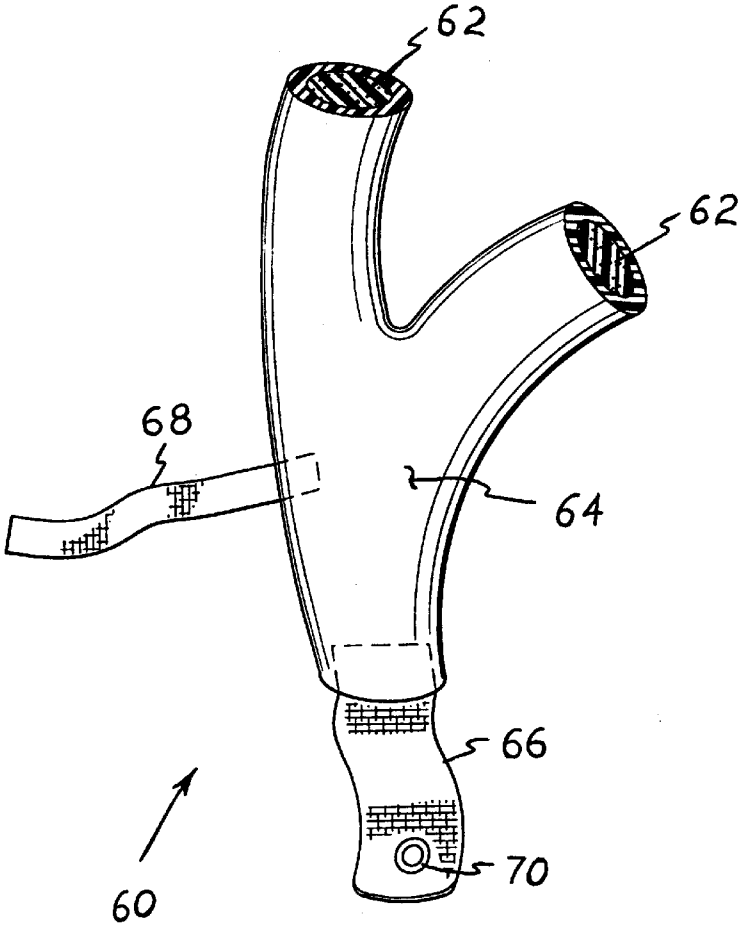
FIG. 5 is a broken away perspective view of the embodiment of FIG. 4, showing the waterproof plastic or rubberized covering of the foam core material and a snap fastener for the separable fastener means.

The present invention comprises various embodiments of a padded cover for protecting hand held hairdryers from damage due to a fall or other impact, particularly for guarding the relatively fragile motor housing or shell of such appliances. FIGS. 1 through 3 illustrate a first embodiment of the present hair dryer protective cover, designated by the reference numeral 10 throughout the drawing Figures. The cover 10 of FIGS. 1 through 3 essentially comprises a first band 12 and a second band 14, each formed of a resilient material 15, as shown in FIG. 2 (open or closed cell foam plastic, foam rubber of suitable density, etc.). The bands 12 and 14 may be covered with a water resistant fabric material or waterproof material, as desired. Other alternative constructions are illustrated in FIGS. 5 and 6, and discussed further below.

Each band 12 and 14 has a first end, respectively 16 and 18, and an opposite second end, respectively 20 and 22. The first ends 16 and 18 are permanently joined (stitched, etc.) to form a first juncture 24 of the two bands 12 and 14, with the opposite second ends also being similarly joined to form a second juncture 26. By joining the two bands 12 and 14 obliquely together, they spread apart at each juncture 24 and 26 to define a medial open area 28 therebetween. The spreading of the two bands 12 and 14 serves to spread them more widely over the oblate shape of the motor case C1 of the hairdryer H1, without requiring a continuous protective sheet over the entire casing C1.

The present protective cover 10 includes hairdryer attachment means for securing the cover over the casing C1, comprising a plurality of straps extending from each juncture and wrapping about the underside of the casing C1 to each side of its attachment with the hairdryer hand grip G1 which extends from the casing C1. In the embodiment of FIGS. 1 through 3, a first elastic strap 30 extends across the first and second junctures 24 and 26 to close the loop defined by the first and second bands 12 and 14 and strap 30. The first strap 30 is in essentially the same plane as that defined by the first band 12, and is adapted to extend behind the hand grip G1 and beneath the casing C1 of the hairdryer H1. A second elastic strap 32 also extends between the first and second junctures 24 and 26, but is oriented to be generally normal or perpendicular to the plane defined by the first band 12 and first strap 30, to wrap about the front side of the hand grip G1 and below the casing C1.

The above described configuration as shown in FIGS. 1 through 3 allows the protective cover 10 to be secured easily to a conventional hand held hairdryer H1, having a forwardly disposed nozzle N1 with a rearwardly disposed inlet I1 at each end of the casing C1. The nozzle N1 is inserted between the first and second straps 30 and 32, and between the second strap 32 and first band 12. The first and second bands 12 and 14 and first strap 30 are then pulled over the top of the casing C1, with the first strap 30 then being brought down around the back of the hairdryer casing C1 and its inlet end I1 to rest adjacent the back of the handgrip G1.

Figure 4:
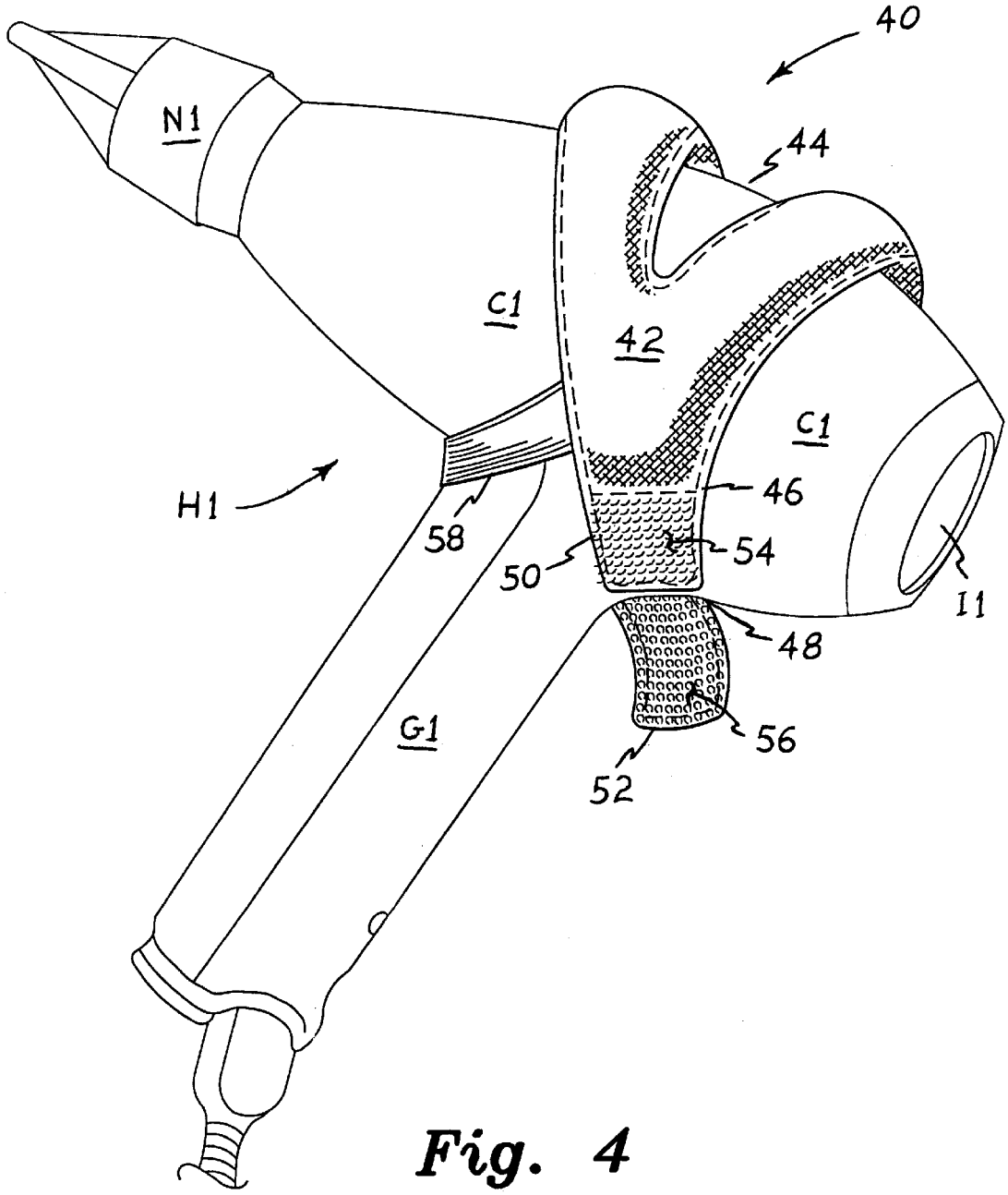
FIG. 4 is an environmental perspective view of a second embodiment of the present protective cover in which the protective bands are formed integrally with one another and in which at least one of the securing straps comprises separable hook and loop fastener material.

Additional variations or embodiments on the present invention are illustrated in the remaining drawing Figures. FIG. 4 illustrates a protective cover 40 embodiment in which the bands which pass over the top of the casing C1 are integrally formed as a unitary structure, rather than being stitched or otherwise fastened together, as in the case of the two bands 12 and 14 of the protective cover 10 of FIGS. 1 through 3. The single band 42 of the cover 40 of FIG. 4 is formed to have a configuration resembling that of the two band cover 10 of FIG. 3, with the band 42 being split to define a generally medial open area 44 in order to broaden the protective area of the band 42 without requiring a continuous unbroken sheet of material.

The band 42 includes a first end 46 and opposite second end 48 to which first and second attachment means are attached, as in the case of the first embodiment 10 of FIGS. 1 through 3. The first attachment means comprises separate rearward first and second straps 50 and 52, which extend respectively from the first and second ends 46 and 48 of the band 42 and are oriented generally coplanar with the body of the band 42. The two straps 50 and 52 are not elastic, but include mating fastening means, such as the first and second types of hook and loop fastener material 54 and 56 (e.g., Velcro™) disposed respectively upon the two straps 50 and 52. The forwardly disposed strap 58 extends between the two ends 46 and 48 of the band 42 and is disposed generally normal to the band 42 and rearward straps 50 and 52, in the manner of the second strap 32 of the cover embodiment of FIGS. 1 through 3.

As the two rearward straps 50 and 52 are not elastic and cannot stretch, they must be separable in order to fit the cover 40 about the hairdryer H1. Otherwise, the cover 40 is applied to a hairdryer H1 having a rearwardly disposed inlet I1, in the manner described further above for securing the cover 10 to a hairdryer H1. The nozzle N1 of the hairdryer H1 is passed between the band 42 and the elastic forward strap 58, with the band 42 being passed over the top of the motor casing C1 until the forward strap 58 contacts the hand grip G1. The separate first and second straps 50 and 52 are then secured about the underside of the casing C1 and behind the hand grip G1 and secured to one another by means of the mating fastener material 54 and 56 respectively provided on each strap end 50 and 52.

It will be seen that various alternatives may be provided for the resilient nature of the bands which encircle the upper portion of the motor case of the hairdryer in accordance with the present invention. FIGS. 5 and 6 illustrate two additional variations on the construction of such protective bands. In FIG. 5, a portion of a band 60 is illustrated, with the band 60 having a core 62 of a resilient foam material hermetically sealed in a waterproof flexible plastic or rubberized cover 64. A rearward strap 66 and portion of the forward strap 68 are shown imbedded in the core material 62, with the cover material 64 being molded in place around the core 62 and straps 66 and 68 extending therefrom. The rearward strap 66 (and its mate, not shown) may include mating snap fasteners 70, or other mating attachment means as desired.

FIG. 6 illustrates yet another embodiment, in which the band 72 comprises a flexible and resilient, hollow, generally tubular structure 74. The hollow structure 74 may be formed of various plastics, natural or synthetic rubber (e. g., Neoprene™), or other suitable materials as desired. The critical point with the material of the band 72 is that it be gas and liquidproof, depending upon the application, as the resilience of the band 72 is provided by filling the hollow core 76 with a gaseous or liquid fluid (e. g., air or water). The attachment straps, e. g., strap 78, may be adhesively secured to the outer surface of the tubular structure 74, or secured using some other suitable means, so long as the wall of the material is not penetrated to allow the fluid within the core 76 to escape. It is recognized that the provision of a fluid core in such a protective device may not be as desirable as a core of solid resilient material, due to the possibility of puncture in the styling salon environment, but such a configuration may be desired by some users, particularly in the case of an air filled core with its resulting light weight.

Figure 7:
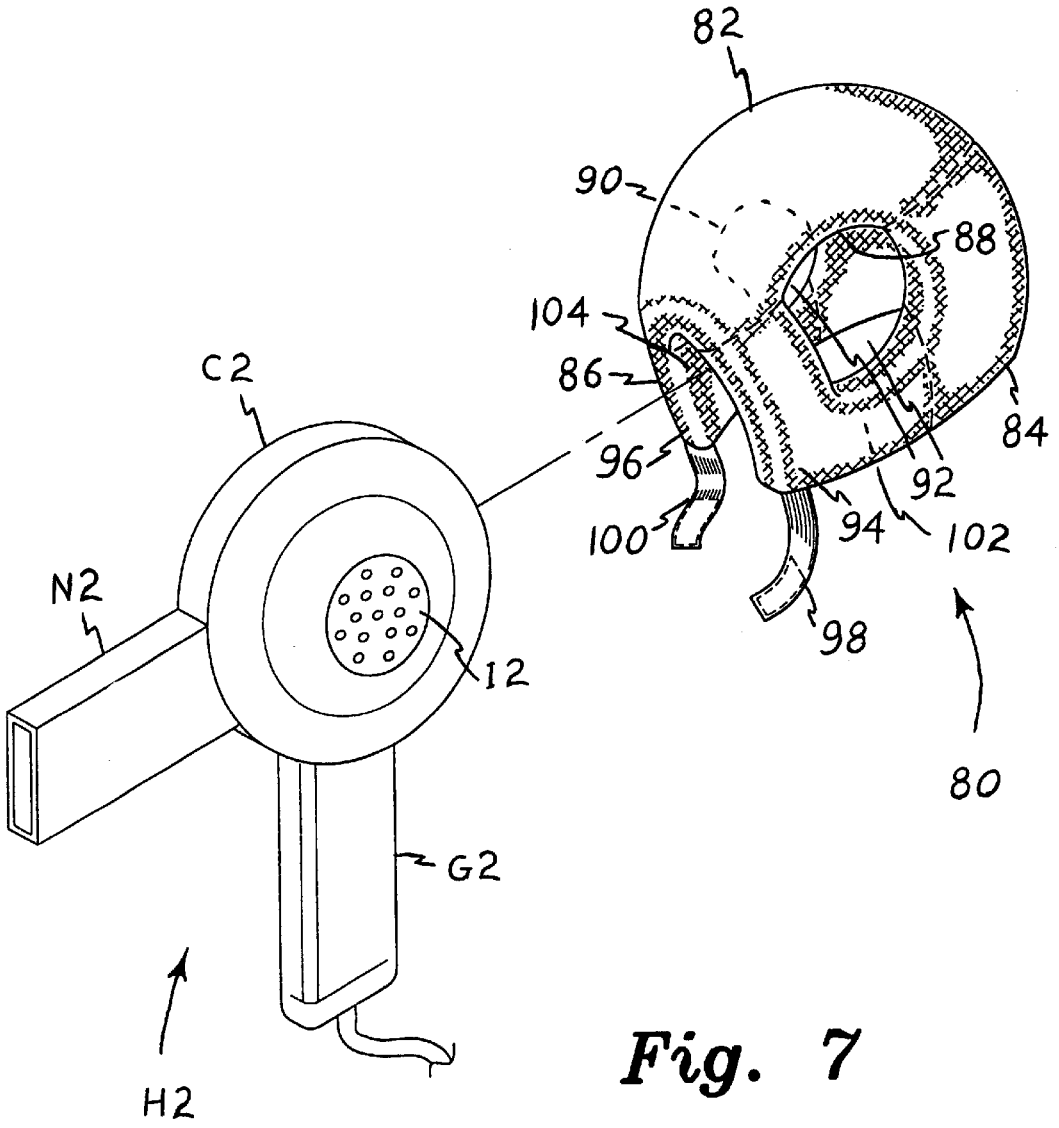
FIG. 7 is an exploded perspective view of still another embodiment of the present invention, comprising a protective cover for a side inlet or side vent type hairdryer and showing the installation of the cover to such a hairdryer configuration.

FIG. 7 illustrates yet another embodiment of the present invention, in which a cover 80 is configured for securing about the motor case C2 of a side inlet type hairdryer H2. The cover 80 comprises a semicircular, arcuately shaped pad 82 which conforms closely to the generally circular curved shape of the outer periphery of the motor case C2 of such a side inlet hairdryer H2. A first and a second side panel, respectively 84 and 86, extend from the respective sides or edges 88 and 90 of the pad 82.

The semicircular pad 82 and side panels 84 and 86 may be formed of the same materials and covered in the same manner as the core and covering materials noted above for previously discussed embodiments of FIGS. 1 through 6. That is, the core of each of the components 82 through 86 may comprise a resilient foam or other impact absorbing material as desired, or the cover 80 may be formed as an integral unit and filled with a liquid or pneumatically filled. The critical point of the cover 80 of FIG. 7, is its shape for enclosing the circular motor casing C2 of a side inlet hairdryer H2, as opposed to the shapes of other cover embodiments for end inlet hairdryers H1, as illustrated in FIGS. 1 and 4.

At least one side panel 84 and/or 86 is provided with an inlet opening 92 formed therethrough, allowing the hairdryer inlet I2 to take in air for heating and blowing from the nozzle N2. Preferably, both panels 84 and 86 are provided with such inlet openings 92, for adaptability for different models of hairdryers which may have their inlet openings on opposite sides of the motor casing.

Each of the side panels 84 and 86 includes an attachment portion, respectively 94 and 96, disposed generally opposite the center of the semicircular motor casing pad 82. First and second straps, respectively 98 and 100, extend respectively from the attachment portions 94 and 96 of the side panels 84 and 86, and attach to one another by mating hook and loop fastener means, as shown with the straps 50 and 52 of FIG. 4, mating snap fastener means, as shown with the strap 66 of FIG. 5, or other mating attachment means (ties, buckles, etc.) as desired.

Alternatively, a single elastic strap may be provided to extend between the two attachment portions 94 and 96 of the two side panels 84 and 86, in the manner of the elastic straps 30 and 32 of FIGS. 1 through 3, if so desired. Where such a single elastic strap is provided, the protective cover 80 may be secured to the hairdryer H2 by passing the nozzle N2 of the hairdryer H2 into the bottom opening 102 defined by the arcuate pad 82 and such a single elastic strap, through the interior of the cover 80, and outwardly through the front opening 104 defined by the forward edge of the pad 82 and the single elastic strip. The cover 80 is worked back over the hairdryer H2 until the strap reaches the juncture between the nozzle N2 and hand grip G2, and the cover 80 is rotated back over the motor casing C2 to position the inlet opening(s) 92 over the inlet(s) I2 of the hairdryer H2.

In summary, the present hairdryer protective cover provides much needed protection for hand held hairdryers of various types from impact damage due to falls or other accidents. Typically, such hairdryers will fall with their motor casings oriented downwardly, due to the mass of the motor and particularly the drag from the trailing cord. The present protective cover embodiments provide the required protection for the motor casing portion of the hairdryer, thus increasing the longevity of such equipment and reducing operational costs for the salon or other operation.

It is to be understood that the present invention is not limited to the embodiments described above, but encompasses any and all embodiments within the scope of the following claims.

I claim:

1. A protective cover for a hand held hair dryer, comprising:

a first and a second resilient band;

each said band having a first end and a second end opposite said first end;

each said first end of said first and said second band being joined obliquely together to form a first juncture, and each said second end of said first and said second band being joined obliquely together to form a second juncture, with each said band defining a medial open area therebetween;

first hairdryer attachment means connecting said first juncture and said second juncture, with said first hairdryer attachment means disposed generally coplanar with said first band; and second hairdryer attachment means connecting said first juncture and said second juncture, with said second hairdryer attachment means disposed generally normal to said first band and to said first hairdryer attachment means.

2. The protective cover according to claim 1, wherein each said resilient band is formed of material selected from the group consisting of resilient foam plastic and foam rubber.

3. The protective cover according to claim 1, wherein each said resilient band comprises a flexible, resilient, impervious, pneumatically inflated outer casing.

4. The protective cover according to claim 1, wherein each said resilient band comprises a flexible, resilient, impervious, liquid filled outer casing.

5. The protective cover according to claim 1, wherein at least one said hair dryer attachment means comprises a continuous elastic strap connecting said first juncture and said second juncture together.

6. The protective cover according to claim 1, wherein at least one said hair dryer attachment means comprises a first strap extending from said first juncture and a second strap extending from said second juncture, with said first strap and said second strap having mating attachment means for removably securing said first strap and said second strap together.

7. A protective cover for a hand held hair dryer, comprising:

a resilient band having a first end, a second end opposite said first end, and a generally medial open area;

first hairdryer attachment means connecting said first end and said second end of said band, with said first hairdryer attachment means disposed generally coplanar with said band; and second hairdryer attachment means connecting said first end and said second end of said band, with said second hairdryer attachment means disposed generally normal to said band and to said first hairdryer attachment means.

8. The protective cover according to claim 7, wherein said resilient band is formed of material selected from the group consisting of resilient foam plastic and foam rubber.

9. The protective cover according to claim 7, wherein said resilient band comprises a flexible, resilient, impervious, pneumatically inflated outer casing.

10. The protective cover according to claim 7, wherein said resilient band comprises a flexible, resilient, impervious, liquid filled outer casing.

11. The protective cover according to claim 7, wherein at least one said hair dryer attachment means comprises a continuous elastic strap connecting said first end and said second end of said band together.

12. The protective cover according to claim 7, wherein at least one said hair dryer attachment means comprises a first strap extending from said first end of said band and a second strap extending from said second end of said band, with said first strap and said second strap having mating attachment means for removably securing said first strap and said second strap together.

13. A protective cover for a hand held hair dryer having at least one side inlet, comprising:

an arcuate resilient pad having at least a first side and a second side opposite said first side;

a resilient first panel extending from said first side of said pad, and a resilient second panel extending from said second side of said pad;

at least one said panel having a hair dryer inlet passage formed therethrough;

each said panel having an attachment portion disposed generally opposite said pad; and hairdryer attachment means connecting said attachment portion of said first panel and said attachment portion of said second panel together.

14. The protective cover according to claim 13, wherein said pad, said first panel, and said second panel are formed of material selected from the group consisting of resilient foam plastic and foam rubber.

15. The protective cover according to claim 13, wherein said pad, said first panel, and said second panel comprise a flexible, resilient, impervious, pneumatically inflated outer casing.

16. The protective cover according to claim 13, wherein said pad, said first panel, and said second panel comprise a flexible, resilient, impervious, liquid filled outer casing.

17. The protective cover according to claim 13, wherein said hair dryer attachment means comprises a continuous elastic strap connecting said attachment portion of said first panel and said attachment portion of said second panel together.

18. The protective cover according to claim 13, wherein said hair dryer attachment means comprises a first strap extending from said attachment portion of said first panel and a second strap extending from said attachment portion of said second panel, with said first strap and said second strap having mating attachment means for removably securing said first strap and said second strap together.

* * * * *